United States Patent [19]

Kunreuther

[11] Patent Number: 4,844,318

[45] Date of Patent: Jul. 4, 1989

[54] NEEDLE ASSEMBLY

[76] Inventor: Steven J. Kunreuther, 285 Central Park West, New York, N.Y. 10024

[21] Appl. No.: 240,681

[22] Filed: Sep. 6, 1988

[51] Int. Cl.[4] ..... B65C 7/00

[52] U.S. Cl. ..... 229/67; 227/95

[58] Field of Search ..... 227/67, 68, 95, 156; 223/102, 104

[56] References Cited

U.S. PATENT DOCUMENTS

| | | | |
|---|---|---|---|
| 3,103,666 | 9/1963 | Bone | 227/67 |
| 3,733,657 | 5/1973 | Lankton | 24/150 FP |
| 4,273,279 | 6/1981 | Kunreuther | 227/67 |
| 4,288,017 | 9/1981 | Russell | 227/67 |
| 4,333,596 | 6/1982 | Kunreuther | 227/67 |
| 4,611,740 | 9/1986 | Kunreuther | 227/67 |

*Primary Examiner*—Frank T. Yost

*Assistant Examiner*—James L. Wolfe

*Attorney, Agent, or Firm*—James & Franklin

[57] ABSTRACT

The needle assembly is removably mounted in an attacher for dispensing tag fasteners of the type having a T-bar connected to a thin flexible filament. The base and shank of the needle include a channel along which the T-bar is moved by the push rod of the attacher and a slit through which the filament extends. A recess, preferably in the form of a slot, is provided in the wall of the shank, extending along the channel, at a circumferential position substantially perpendicular to the plane intersecting the shank and passing through the slit. The slot provides clearance for the T-bar to release from the push rod if the previously severed connecting element has become deformed by being wedged between the push rod and the channel wall.

8 Claims, 3 Drawing Sheets

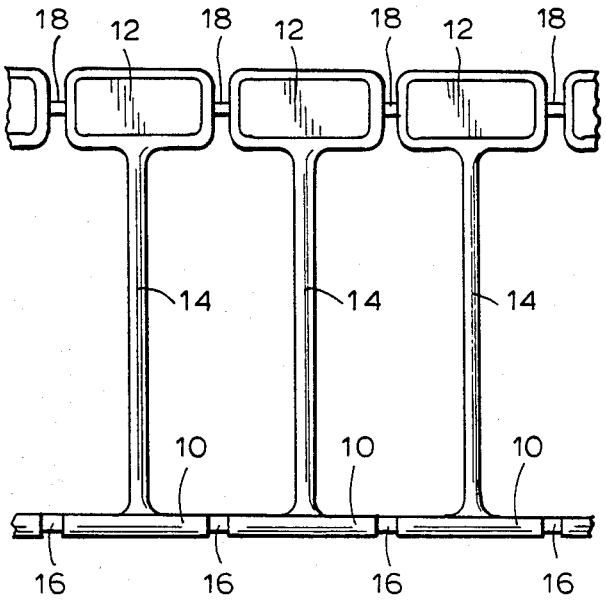
FIG. 1
FIG. 2
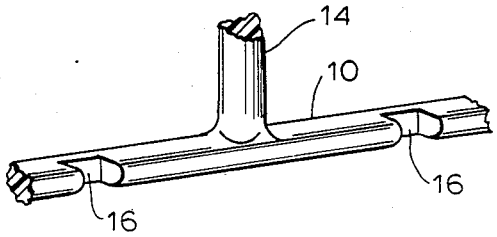
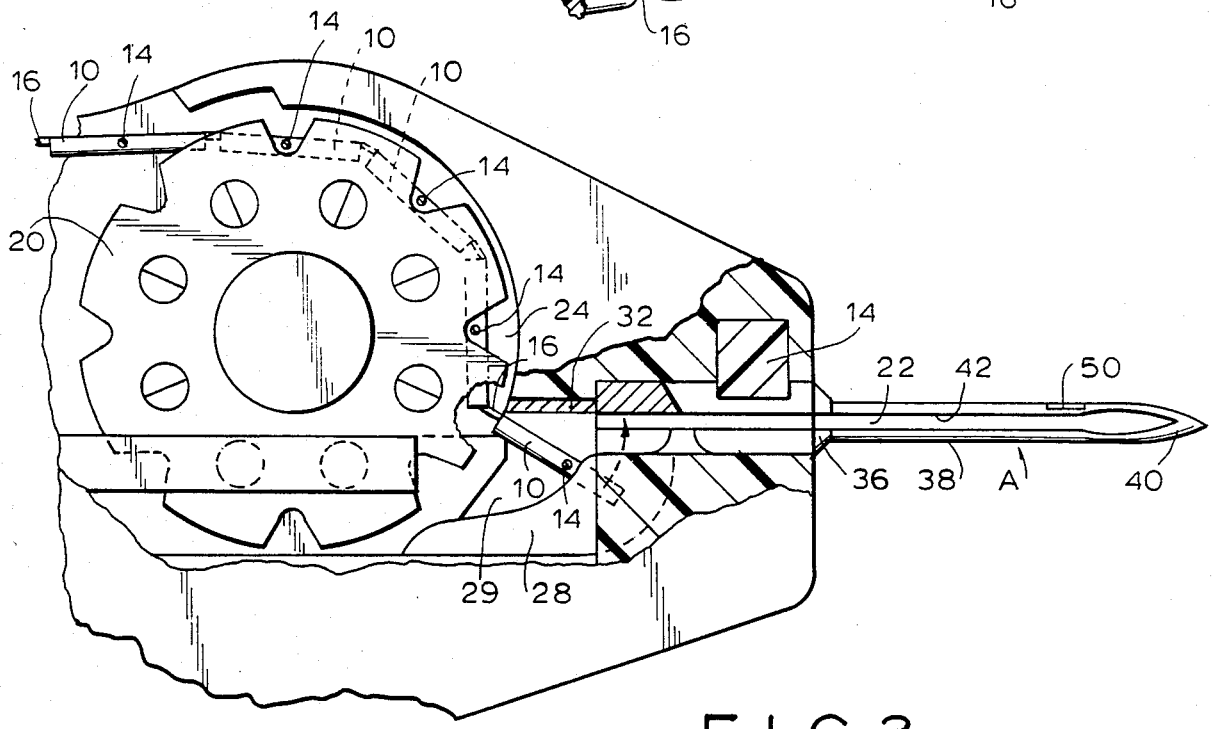
FIG. 3

NEEDLE ASSEMBLY

The present invention relates to needle assemblies designed for use with attachers which dispense fasteners for attaching tags and the like to articles such as clothing or other soft goods. The fasteners are of the well known stretched plastic type which are made of polyporpylene or nylon and consist of a T-bar and an enlarged paddle end connected together by a thin flexible filament. Such fasteners are commercially available from a number of different sources, including Dennison Manufacturing Company of Framingham, Mass. and Texpak, Inc. of New York, NY.

Fasteners of this type are molded and sold in assemblies. In one style, the assemblies consist of clips of fifty or one hundred fasteners connected in parallel, along a runner bar. In a second type, the fasteners are connected in a continuous strip. The ends of adjacent T-bars and the edges of adjacent paddle ends are respectively connected together by bridge or connecting elements.

Each style fastener is dispensed by attachers of different design. Examples of the types of attachers which are designed to dispense attachments of the first style are described in U.S. Pat. No. 3,103,666 to Arnold Bone, dated Sept. 16, 1963 and entitled "TAG ATTACHING APPARATUS" and in U.S. Pat. No. 3,733,657 to Gordon Lankton, dated May 22, 1973 and entitled "ASSEMBLY OF ATTACHMENTS AND METHOD OF MANIPULATING THE SAME". An attacher for dispensing the second style of fasteners is described in U.S. Pat. No. 4,288,017 to David Russell, dated Sept. 8, 1981 and entitled "METHOD AND APPARATUS FOR DISPENSING FASTENERS".

One feature that all types of attachers have in common is that they all utilize a hollow needle assembly mounted at the forward end of the attacher through which the T-bars of the fasteners are dispensed. The needle assemblies commonly have a cylindrical base designed to be removably mounted in a recess in the attacher and a metal shank which extends forward of the attacher and terminates in a sharp tip.

The operator places a tag on the surface of the garment, at the position whether the tag is to be affixed. The attacher is then manipulated such that the tip of the needle penetrates the tag and the garment. Actuating the attacher then causes the T-bar of fastener to travel through a channel in the needle and to be dispensed such that it will be anchored on the opposite side of the garment. The enlarged panel end of the attachment prevents the tag or garment from being removed from the filament.

Since the fasteners are loaded into the attachers in a clip or a roll, each fastener must be separated from the adjacent fasteners, prior to being dispensed. This operation is achieved through the use of a knife or severing edge which may be a part of the needle itself, located at the rear of the base, or may be a blade separately mounted within the attacher.

A serious problem commonly encountered when working with attachers of the second type, which require severing of the connecting elements between adjacent T-bars, is that of the failure of the T-bar to be released from the push rod of the attacher as it completes the path of travel through the channel of the needle. This occurs because a portion of the connecting element remains on the fastener, at the trailing end of the T-bar, after the T-bar is severed from the adjacent T-bar. As the T-bar is pushed through the channel in the needle assembly by the attacher push rod, the connecting element may lodge between the push rod and the surface of the channel wall, causing it to become deformed and adhere to the tip of the push rod. This often results in the T-bar failing to release the push rod and hence failing to be dispensed from the needle.

When the trigger actuator of the gun is released and the pusher rod retracts into the gun, the lodged section of the connector element remains affixed to the push rod and the T-bar of the fastener is pulled back into the needle. This prevents the fastener from becoming secured properly to the garment. While this problem is bothersome to the operator when garments are tagged manually, it becomes extremely serious when fastening guns are used in automated attaching equipment such as described in U.S. Pat. No. 4,235,161 issued to Steven Kunreuther dated Nov. 25, 1980 and entitled AUTOMATIC TAG ATTACHING APPARATUS.

Manufacturers of fastening equipment have been aware of this problem for some time. They have attempted to alleviate the problem by redesigning the molds which manufacture the fasteners and by changing the shape of the push rod. Both methods are costly and thus far have not solved the problem. The present invention is designed to eliminate the problem.

The present invention may be used in needle assemblies which are manufactured by milling or by stamping. It is applicable to needles which are of the single piece steel construction as well as those which have a plastic base. It is useable on needles which have a built-in knife edge and those which do not.

Conventional needle designs can be modified in accordance with the present invention to produce improved needles without substantial additional expense. Further, only conventional manufacturing equipment is required in order to fabricate a needle assembly with the structure of the present invention.

It is, therefore, a prime object of the present invention to provide an improved needle assembly which prevents failure of a T-bar to be released from the needle, because the connecting element has deformed and adheres to the push rod.

It is another object of the present invention to provide an improved needle assembly which can be manufactured without substantially increasing the cost of the needle assembly.

It is another object of the present invention to provide an improved needle assembly which can be manufactured on conventional milling and stamping equipment.

In accordance with the present invention, a needle assembly is provided for use with an attacher of the type adapted to dispense fasteners having a T-bar connected to a thin flexible filament. The attacher includes a rod designed to push the T-bar of the fastener through the needle assembly. The needle assembly includes a shank with a tip portion at the forward end thereof and a base affixed to the other end of which is adapted to be mounted in the attacher. The base and shank include a channel through which the T-bar of the fastener moves as it is pushed by the push rod and a slit through which the filament extends. The improvement comprises a recess in the shank, along the channel, for providing additional clearance adjacent the push rod.

The recess is located at a position along the axis of the needle proximate the forward position of the push rod and at a circumfrential position in the shank aligned with the location of the connecting element. In fasteners operated through the unit described in U.S. Pat. No. 4,288,017 the circumfrential position is approximately perpendicular to the plane intersecting the shank and passing through the slit.

The T-bars of adjacent filaments are connected by elements. The recess is large enough to receive a substantial portion of the connecting element therein. However, the slot must be small enough so that the T-bar cannot enter it.

Preferably, the recess comprises a slot. It also preferably is elongated along the channel.

The forward tip of the push rod is displaceable between a forward position within the assembly and a rear position behind the needle assembly. The recess preferably extends from a point along the channel proximate the forward position of the push rod tip toward the base of the needle assembly. The recess extends from that point towards the base a distance approximately one-half the length of the T-bar of the fastener.

To these and such other objects which may hereinafter appear, the present invention relates to an improved needle assembly as descirbed in the following specification and recited in the annexed claims, taken together with the accompanying drawings, wherein like numerals refer to like parts and in which:

FIG. 1 is a plan view of the continuous strip style fasteners of the type dispensed by an attacher designed to employ the improved needle assembly;

FIG. 2 is an enlarged isometric view of the T-bar of one of the fasteners illustrated in FIG. 1;

FIG. 3 is a plan partially cut away view of the forward portion of an attacher designed to dispense attachments of the type illustrated in FIGS. 1 and 2;

Figure 4:
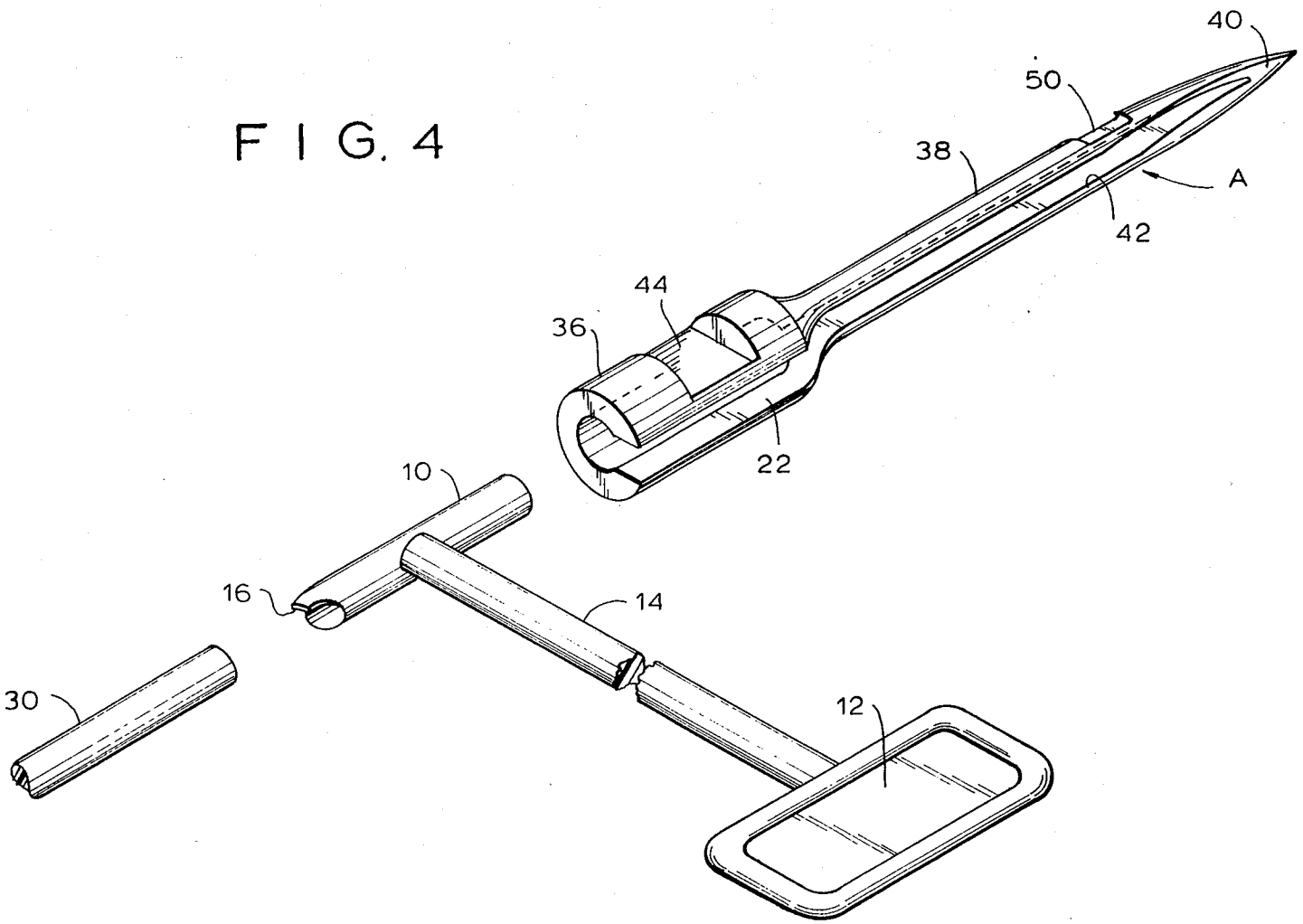
FIG. 4 is an exploded isometric view of a fastener and the needle assembly of the present invention.

FIG. 1 illustrates the continuous strip fasteners or attachments of the type designed for use in an attacher which may include the improved needle assembly of the present invention. Each of the fasteners includes a T-bar 10 and enlarged paddle end 12 connected by a thin flexible filament 14. The fasteners are ejection molded and composed of plastic such as a polypropylene or nylon. The filaments are stretched to enhance their strength and flexibility. The fasteners are molded in a continuous strip. Adjacent T-bars are connected by elements 16 (see FIG. 2) and adjacent paddle end edges are connected by elements 18 to form the strip. Element 18 causes no feed problems in this or other guns since it does not feed through the attacher. The paddles separate automatically as the attacher is moved away from the garment.

The fasteners are would into a coil (not shown) and mounted on the attacher. They are then dispensed onto a revolving feed wheel 20, as illustrated in FIG. 3. The forward most fastener T-bar is indexed about wheel 20 to a position in alignment with the rear of the bore or channel 22 of the needle assembly, generally disignated A. Wheel 20 has notches about its periphery for receiving the fasteners filaments 14 and advancing them in an arcuate path to a position adjacent the needle assembly A. Wheel 20 is spaced from the inner wall of the attacher housing to define a passageway 24 for receiving and guiding the T-bars 10 as the wheel 20 rotates. The attacher housing is structured to aid in restraining the T-bars for travel through the provided passageway 24.

A projecting tab 28 is provided in the housing, in the vertical plane of wheel 20, forming an extension of the passageway 24 about the wheel 20 to guide in the T-bars 10 during rotation. Tab 28 has a curved upper surface 29 configured to guide the filament 14 projecting from the wheel 20 as the T-bar 10 is rotated into alignment with needle A.

After the T-bar is aligned with the needle channel or bore 22, a plunger or push rod 30 (not visible in FIG. 3) is brought forward to contact the free rear end of the aligned T-bar 10 to push it through the hollow needle bore 22, simultaneously breaking or cutting the connector element 16 at severing means 32. The push rod 30 drives the T-bar 10 of the fastener through the needle bore 22. It is necessary that the bore 22 have a diameter only slightly larger than the diameter of the T-bar so that lateral movement of the T-bar is prevented. Otherwise, the T-bar can lodge within the bore as it is being pushed by the push rod 30 and cause a jam.

After the T-bar 10 is severed from the adjacent T-bar 10, the connecting element 16 remains therein (see FIG. 4). The advancing tip of the push rod 30 is substantially coaxial with the end of the T-bar 10. As the push rod 30 advances, element 16 may be cammed radially outwardly and may wedge in the very small space between the push rod 30 and the wall of the bore 22 of the needle. In this case, the element may become elongated and stretched as the T-bar moves forward. As this occurs, element 16 becomes deformed, conforming to the contours of the push rod surface. At the end of the path of travel of the push rod, the deformed element does not release from the tip of the rod. Thus, the fastener is not dispensed.

The needle assembly includes a base 36 designed to be received in the attacher and a shank 38 having a sharpened tip 40 at its forward end. The needle may be formed by milling or stamping and may have a base 36 made of metal or plastic. The channel or bore 22 formed in the base 36 and the shank 38 is formed so it is just large enough to permit the T-bar 10 of a fastener to travel without substantial lateral movement. A slit 42 within the base 36 and shank 38 is provided to permit the filament 14 of the fastener to extend out of the needle assembly as the T-bar 10 passes through the bore 22. On the top of the base 36 is a recess 44 which cooperates with a correspondently shaped pin 46 in the attacher to engage the needle and secure same within the attacher.

Figure 6:
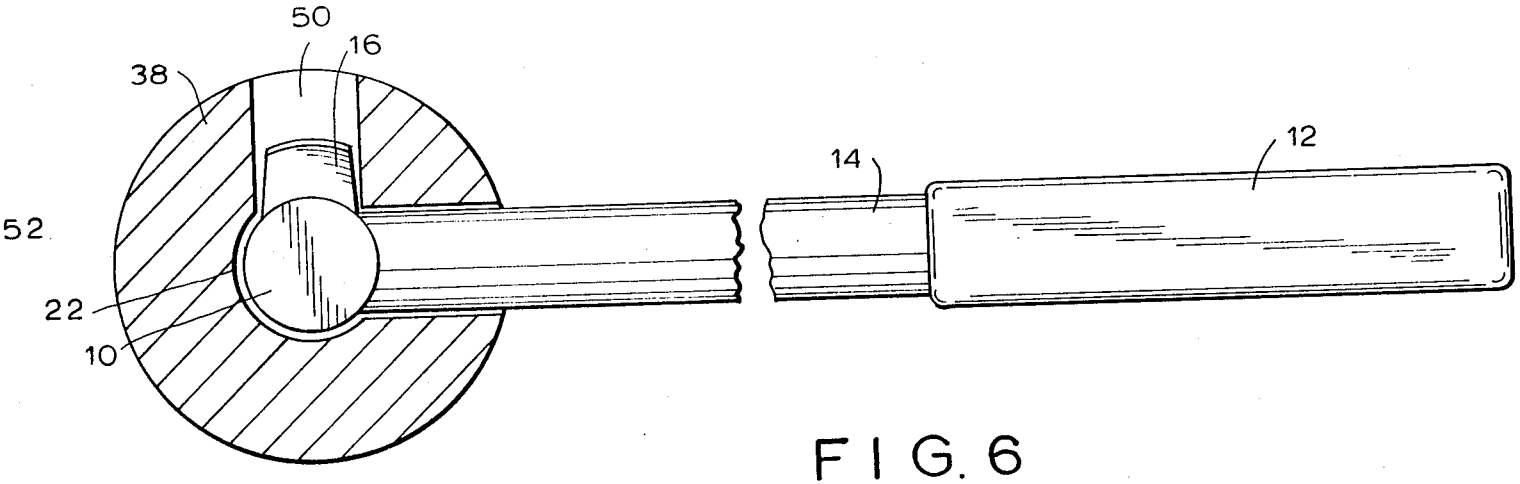
FIG. 6 is a greatly enlarged cross-sectional view taken along lines 6-6 of FIG. 5, showing the needle assembly of the present invention with an attachment therein.

The needle assembly of the present invention differs from a conventional needle assembly in that the shank 38 is provided with a recess, preferably in the form of a slot 50. As shown in FIG. 6, which is a cross-sectional view of the shank, slot 50 is located at a circumfrential position, along channel 22, substantially perpendicular to the plane (illustrated by dashed line 52) which intersects the shank 38 and passes through slit 42. Slot 50 is located in this circumfrential position in order to align with the position of element 16. If a different design fastener were used, and element 16 were in a different position on the T-bar the slot would have to be relocated to a different circumfrential position so as to be in alignment with the new location of element. Slot 50 must be large enough so that a substantial portion of element 16 can be received therein, providing enough room for the element to substantially recover its predeformation shape and release the push rod top. However, slot 50 is not wide enough to receive the T-bar end therein and therefore cause a jam. Slot 50 is elongated in the direction of the channel or bore 22.

Figure 5:
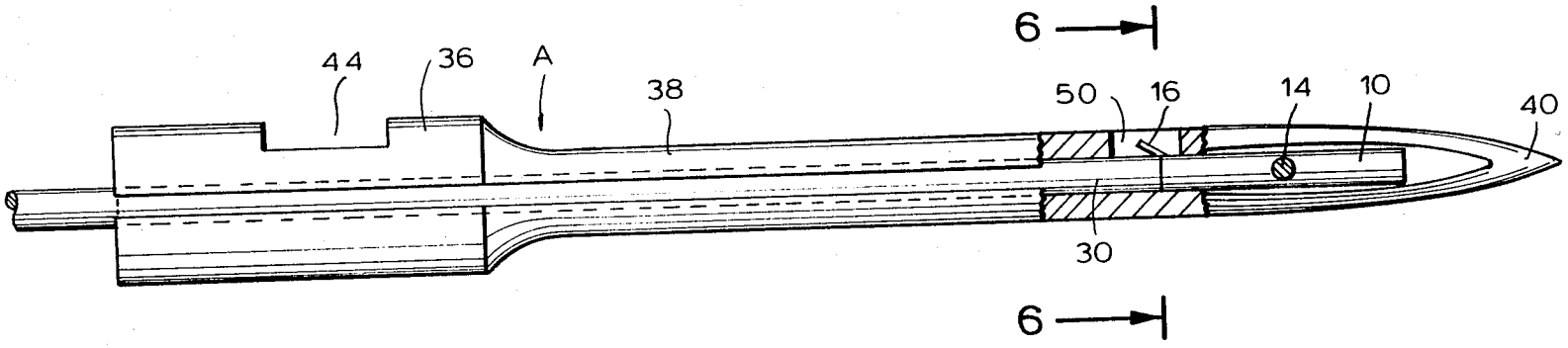
FIG. 5 is an enlarged side view of the needle assembly of the present invention showing the ejector rod pushing the T-bar of a fastener through the shank.

FIG. 5 shows the needle of the present invention with the push rod 30 at its forwardmost position. As illustrated, the leading edge of slot 50 is preferably located along the axis of the shank 38 at a point just forward of the forwardmost position of rod 30. The slot extends rearwardly towards base 36 a distance approximately equal to one-half of the length of T-bar 10.

It should be appreciated that different attachers have different length push rods and push rods with different forward positions. FIG. 5 illustrates a preferred axial position of slot 50. However, other axial positions and/or sizes for the slot may be required for different attachers.

The recess or slot 50 provides clearance within the bore 22 of the shank 38 to accommodate the connection element 16, as the T-bar approaches the end of the needle. Even if element 16 has wedged along side of the push rod 30, becoming deformed and adhering to the end of the push rod, the T-bar will release from the needle without impediment because of this clearance.

Recess or slot 50 can be formed in the wall of the shank 38 before the shank is formed into its U-shape cross section. This can be accomplished by an additional milling operation or, if the needle is stamped, the stamp can be provided with an additional protrusion so as to form the recess or slot. Thus, conventional techniques are all that is necessary to form same does not add significantly to the overall cost of the finished product.

It will now be appreciated that the present invention relates to a needle assembly which eliminates the problem of T-bars which fail to release from the push rod inherent in continuous strip type fastener attachers where the ends of adjacent T-bars are connected by elements which remain after the fasteners are severed. In particular, the present invention includes a needle assembly with a shank having a recess or slot adjacent the bore which accommodates a connecting element should it become deformed by wedging between the push rod and channel wall and fail to be dispensed.

While only a single preferred embodiment of the presnet invention has been disclosed for purposes of illustration, it is obvious that any variations and modifications could be made thereto. It is intended to cover all of these variations and modifications which fall within the scope of the presentation as defined by the following claims:

I claim:

1. In a needle assembly for use with an attacher adapted to dispense fasteners having a T-bar connected to a thin flexible filament, the fasteners being connected together by elements extending between the T-bars, the attacher including a displaceable rod to push the T-bar of the fastener through the needle assembly, the needle assembly comprising a shank with a forward end, a tip portion at the forward end of said shank and a base affixed to the other end of said shank and adapted to be received in the attacher, said base and said shank including a channel through which the T-bar of the fastener is moved by the rod and a slit through which the filament extends, the improvement comprising a recess in said shank, along the channel, for providing additional clearance adjacent the push rod, said recess being aligned with said element when the T-bar is situated in the channel.

2. The needle assembly of claim 1 wherein said recess is located proximate the forwardmost position of the push rod.

3. The needle assembly of claim 1 wherein said recess comprises a slot.

4. The needle assembly of claim 1 wherein said slot is elongated along the channel.

5. The assembly of claim 1 wherein the tip of the push rod is displaceable between a forward position, within said needle assembly, and the rear position, behind said needle assembly, and wherein said recess extends from a point on said shank proximate said forward position, toward said base.

6. In a needle assembly for use with an attacher adapted to dispense fasteners having a T-bar connected to a thin, flexible filament, the attacher including a displaceable rod to push the T-bar of the fastener through the needle assembly, the needle assembly comprising a shank with a forward end, a tip portion at the forward end of said shank and a base affixed to the other end of said shank and adapted to be received in the attacher, said base and said shank including a channel through which the T-bar of the fastener is moved by the rod and a slit through which the filament extends, the improvement comprising a recess in said shank, along the channel, for providing additional clearance adjacent the push rod, said recess being circumferentially positioned approximately perpendicular to the plane intersecting said shank and passing through said slit.

7. In a needle assembly for use with an attacher to dispense fasteners having a T-bar connected to a thin flexible filament, the T-bars of adjacent fasteners being connected by an element, the attacher including a displaceable rod to push the T-bar of the fastener through the needle assembly, the needle assembly comprising a shank with a forward end, a tip portion at the forward end of said shank and a base affixed to the other end of said shank and adapted to be received in the attacher, said base and said shank including a channel through which the T-bar of the fastener is moved by the rod and a slit through which the filament extends, the improvement comprising a recess in said shank, along the channel, for providing additional clearance adjacent the push rod, said recess being large enough to receive a substantial portion of the connecting element therein, but smaller than the diameter of the T-bar.

8. In a needle assembly for use with an attacher to dispense fasteners having a T-bar connected to a thin flexible filament, the attacher including a displaceable rod to push the T-bar of the fastener through the needle assembly, the push rod being displaceable between a forward position, within said needle assembly, and a rear position, behind said needle assembly, the needle assembly comprising a shank with a forward end, a tip portion at the forward end of said shank and a base affixed to the other end of said shank and adapted to be received in the attacher, said base and said shank including a channel through which the T-bar of the fastener is moved by the rod and a slit through which the filament extends, the improvement comprising a recess in said shank, along the channel, for providing additional clearance adjacent the push rod, said recess extending from a point on said shank proximate said forward position, toward said base, a distance approximately equal to one-half of the length of the T-bar of the fastener.

* * * * *